US009738425B2

(12) United States Patent
Shrader et al.

(10) Patent No.: US 9,738,425 B2
(45) Date of Patent: Aug. 22, 2017

(54) REFRIGERATOR, REFRIGERATOR DOOR, AND A REFRIGERATOR DOOR BIN WITH A TWO-PIECE LID

(71) Applicant: Electrolux Home Products, Inc., Charlotte, NC (US)

(72) Inventors: Benjamin Paul Shrader, Charlotte, NC (US); Brent Aaron Curtis, Anderson, SC (US)

(73) Assignee: Electrolux Home Products, Inc., Charlotte, NC (US)

( * ) Notice: Subject to any disclaimer, the term of this patent is extended or adjusted under 35 U.S.C. 154(b) by 65 days.

(21) Appl. No.: 14/536,790

(22) Filed: Nov. 10, 2014

(65) Prior Publication Data

US 2016/0131415 A1 May 12, 2016

(51) Int. Cl.

| | |
|---|---|
| ***A47B 96/04*** | (2006.01) |
| ***B65D 43/16*** | (2006.01) |
| ***F25D 23/04*** | (2006.01) |

(52) U.S. Cl.

CPC ..... *B65D 43/16* (2013.01); *F25D 23/04* (2013.01); *B65D 43/164* (2013.01)

(58) Field of Classification Search

CPC ..... B65D 43/16; B65D 43/161; B65D 43/163–43/168; F25D 23/04

See application file for complete search history.

(56) References Cited

U.S. PATENT DOCUMENTS

| | | | | |
|---|---|---|---|---|
| 3,295,907 | A | 1/1967 | Galvin | |
| 3,729,243 | A | 4/1973 | Musgrave et al. | |
| 4,798,425 | A | 1/1989 | Armstrong et al. | |
| 5,193,892 | A | 3/1993 | Swindell | |
| 5,289,616 | A * | 3/1994 | Taniyama | E05D 11/06 16/374 |
| 5,673,811 | A | 10/1997 | Dickinson et al. | |
| 6,074,030 | A * | 6/2000 | Prunty | E05F 5/02 16/374 |
| 7,300,120 | B2 * | 11/2007 | Shin | F25D 23/04 108/108 |
| 7,686,406 | B2 | 3/2010 | Lee | |
| 8,152,255 | B2 * | 4/2012 | Nam | F25D 25/025 312/270.3 |
| 8,152,257 | B2 * | 4/2012 | Kim | F25D 23/04 312/405.1 |

(Continued)

FOREIGN PATENT DOCUMENTS

| | | | |
|---|---|---|---|
| DE | 102011075561 A1 * | 11/2012 | F25D 23/04 |

*Primary Examiner* — Daniel J Troy

*Assistant Examiner* — Andres F Gallego

(74) *Attorney, Agent, or Firm* — Pearne & Gordon, LLP

(57) ABSTRACT

A storage bin includes a container portion and a two-piece lid mechanism. The two-piece lid mechanism has a front lid portion that covers the front part of the container portion and a rear lid portion that covers the rear area of the container portion. When the front lid portion is opened, the rear lid portion slides along the top surface of the front lid portion while the front lid portion fits rotatably underneath the rear lid portion in such a way that when the front lid portion and the rear lid portion are completely opened, the lid portions do not extend above the top plane surface of the two-piece lid mechanism. The storage bin may be mounted within a recess in the inner wall of a refrigerator door.

23 Claims, 9 Drawing Sheets

(56) References Cited

U.S. PATENT DOCUMENTS

| | | | | |
|---|---|---|---|---|
| 2008/0197040 | A1* | 8/2008 | Lin | B25H 3/021<br>206/509 |
| 2008/0271475 | A1 | 11/2008 | Wuesthoff et al. | |
| 2010/0140284 | A1* | 6/2010 | Kim | F25D 23/04<br>220/810 |
| 2013/0278128 | A1* | 10/2013 | Borgonovo | F25D 23/04<br>312/408 |

* cited by examiner

REFRIGERATOR, REFRIGERATOR DOOR, AND A REFRIGERATOR DOOR BIN WITH A TWO-PIECE LID

FIELD OF INVENTION

The following description relates generally to a storage system for a refrigerator, and more specifically to a two-piece lid mechanism for a refrigerator bin mounted within a recess of an inner wall of a refrigerator door.

BACKGROUND OF INVENTION

Refrigerators traditionally have one or more doors providing access to the stored items within the fresh food and the freezer compartments. Refrigerator doors typically include shelves or bins mounted to the interior of the door. Storage bins may be designed for specific purposes, such as storing dairy products in various small containers or milk jugs.

Traditional door-mounted bins have a single-piece rotating lid.

SUMMARY

The present invention provides a storage bin, and a refrigerator.

In one general aspect, the storage bin, according to the present invention, may include a container and a two-piece lid mechanism. The two-piece lid mechanism may include a front lid portion configured to cover the front area of the container portion and a rear lid portion configured to cover the rear area of the container portion. When the front lid portion is opened, the rear lid portion may be configured to slide along the top surface of the front lid portion. At the same time, the front lid portion may be configured to rotatably fit underneath the rear lid portion.

The storage bin may be configured to be mounted within one or more recesses in an inner wall of a refrigerator door.

In another general aspect, a refrigerator may be provided. The refrigerator may include at least one cabinet, at least one door, and at least one storage bin mounted within a recess in the inner wall of the refrigerator door. The storage bin may include a container portion and a two-piece lid mechanism. The two-piece lid mechanism may include a front lid portion configured to cover the front area of the container portion and a rear lid portion configured to cover the rear area of the container portion. When the front lid portion is opened, the rear lid portion may be configured to slide along the top surface of the front lid portion. At the same time, the front lid portion is configured to rotatably fit underneath the rear lid portion.

In another general aspect, a refrigerator door may be provided. The door may include at least one inner wall, at least one recess formed in the inner wall, and at least one storage bin mounted within the recess. The storage bin may include a container portion and a two-piece lid mechanism. The two-piece lid mechanism may include a front lid portion configured to cover the front area of the container portion and a rear lid portion configured to cover the rear area of the container portion. When the front lid portion is opened, the rear lid portion may be configured to slide along the top surface of the front lid portion. At the same time, the front lid portion may be configured to rotatably fit underneath the rear lid portion.

Other features and aspects may be apparent from the following detailed description, the drawings, and the claims.

BRIEF DESCRIPTION OF THE DRAWINGS

The foregoing and other aspects of the present disclosure will become apparent to those skilled in the art to which the present disclosure relates upon reading the following description with reference to the accompanying drawings, in which.

Figure 1:
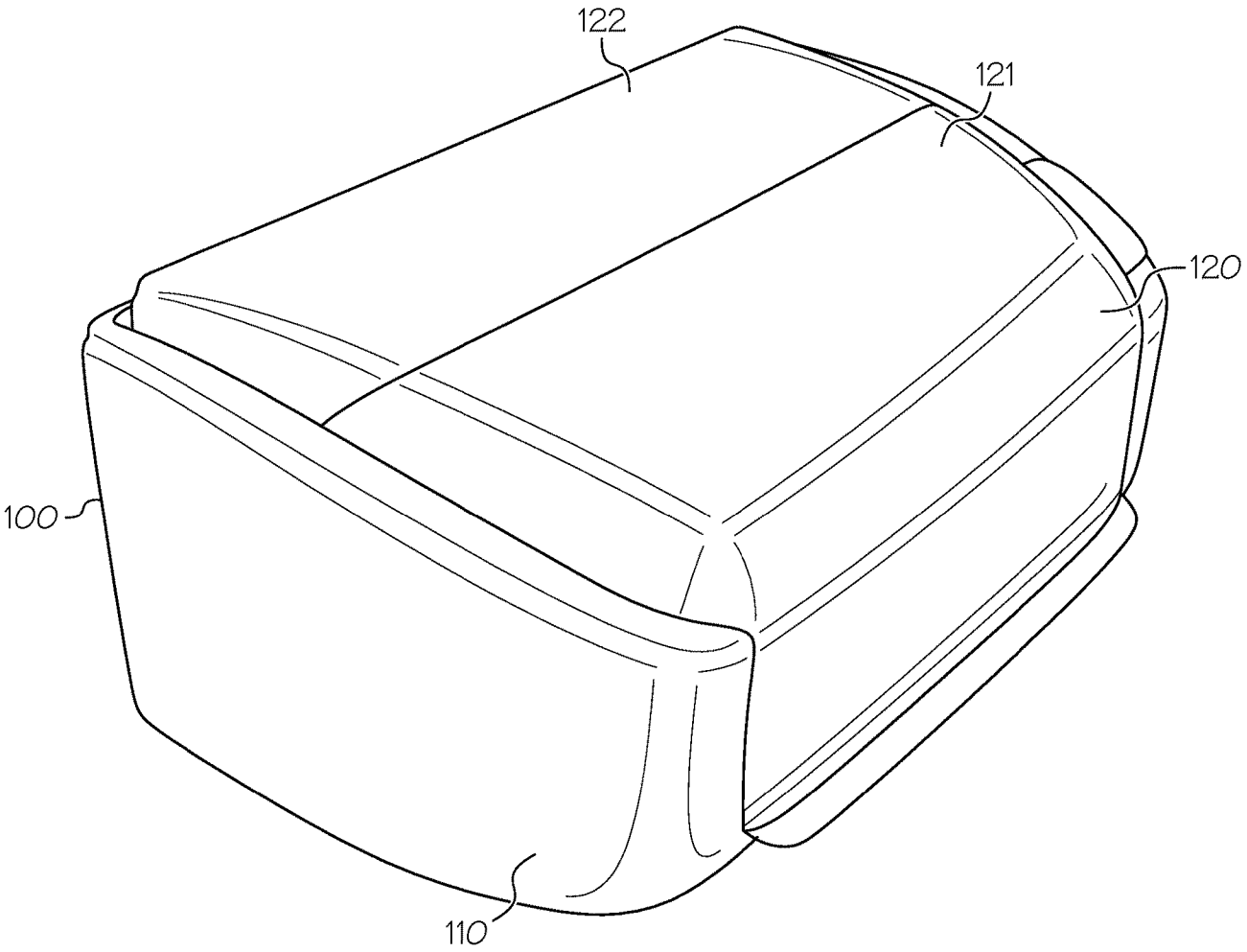
FIG. 1 is a perspective view of an example storage bin according to an embodiment with the front lid portion fully closed.

Throughout the drawings and the detailed description, unless otherwise described, the same drawing reference numerals will be understood to refer to the same elements, features, and structures. The relative size and depiction of these elements may be exaggerated for clarity, illustration, and convenience.

DETAILED DESCRIPTION

Example embodiments that incorporate one or more aspects of the apparatus and methodology are described and illustrated in the drawings. These illustrated examples are not intended to be a limitation on the present disclosure. For example, one or more aspects of the disclosed embodiments can be utilized in other embodiments and even other types of devices. Moreover, certain terminology is used herein for convenience only and is not to be taken as a limitation.

FIG. 1 illustrates an example of a storage bin 100 according to an embodiment. The storage bin 100 has a container portion 110, in which various items may be stored. The storage bin 100 also has a two-piece lid mechanism 120 that covers items that may be stored in the container portion 110. The two-piece lid mechanism 120 can be used to open the container portion 110 when the user wishes to access the items stored in the container portion 110. The two-piece lid mechanism 120 can be also used to close the container portion 110 when access to the items stored in the container portion 110 is no longer desired.

The two-piece lid mechanism 120 has a front lid portion 121 and a rear lid portion 122. The front lid portion 121 covers the front area of the container portion 110. When it is open, the front lid portion 121 provides access to the items stored in the container portion 110. The rear lid portion 122 covers the rear area of the container portion 110.

Figure 2:
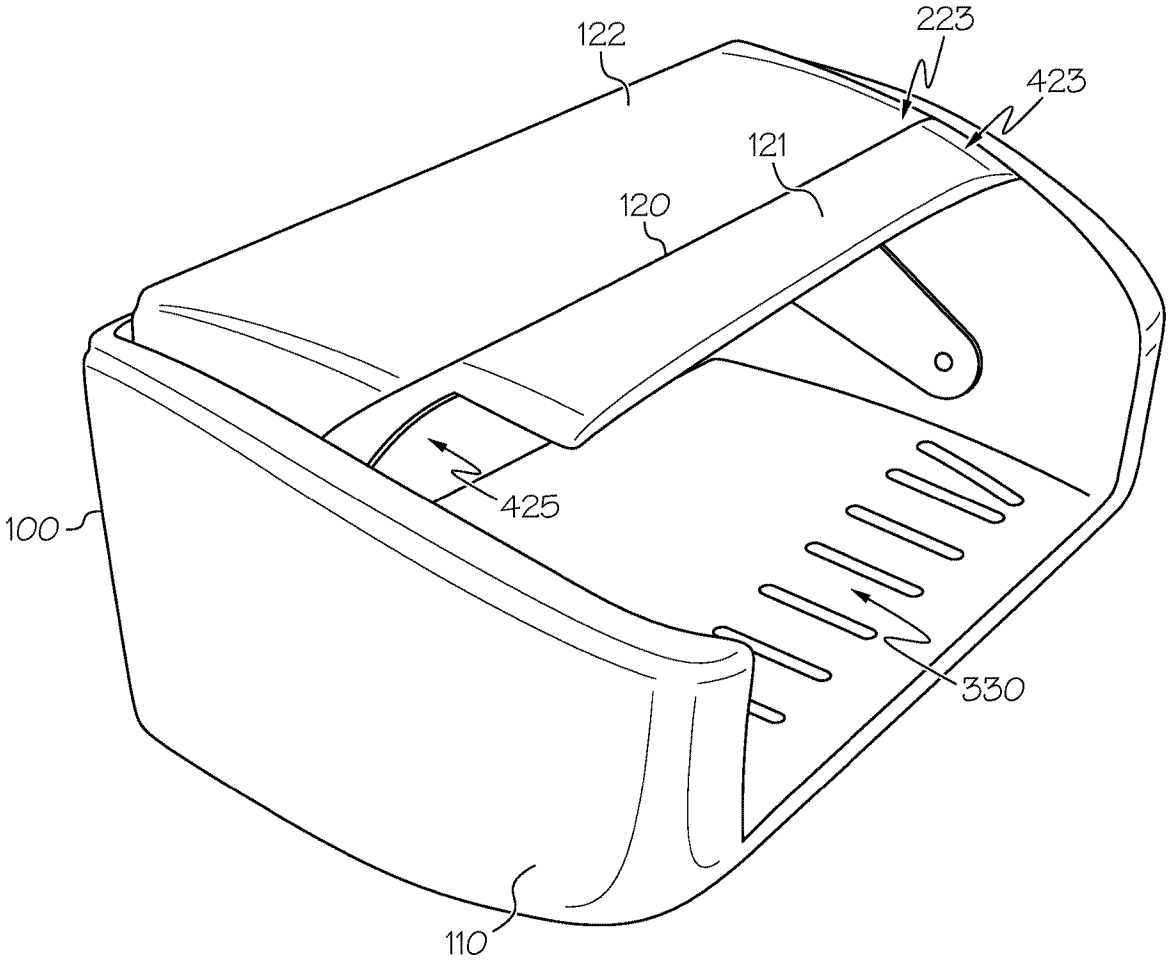
FIG. 2 is a perspective view of an example storage bin according to an embodiment with the front lid portion fully opened.

FIG. 2 shows the storage bin 100 with the front lid portion 121 fully opened. When the front lid portion 121 is fully opened, neither the front lid portion 121 nor the rear lid portion 122 extend above the top plane surface 223 of the two-piece lid mechanism 120 when the two-piece lid mechanism 120 is in a closed position. Therefore, the fully-opened two-piece lid mechanism 120 will not extend above the fresh food door of the refrigerator and will not interfere with the cabinet when the user attempts to close the refrigerator door.

The front lid portion 121 and the rear lid portion 122 shown in FIG. 1 and FIG. 2 can be made of a transparent material, allowing the user to inspect the contents of the storage bin 100 without opening the two-piece lid mechanism 120. Alternatively, the front lid portion 121 and the rear lid portion 122 can be made of a non-transparent material.

The two-piece lid mechanism 120 may be used for storage bins of different sizes. The storage bin can be sized to hold a gallon container of milk or a carton of soft drinks, for example. Alternatively, the storage bin can be sized to hold not more than a specific number of smaller items.

Figure 3:
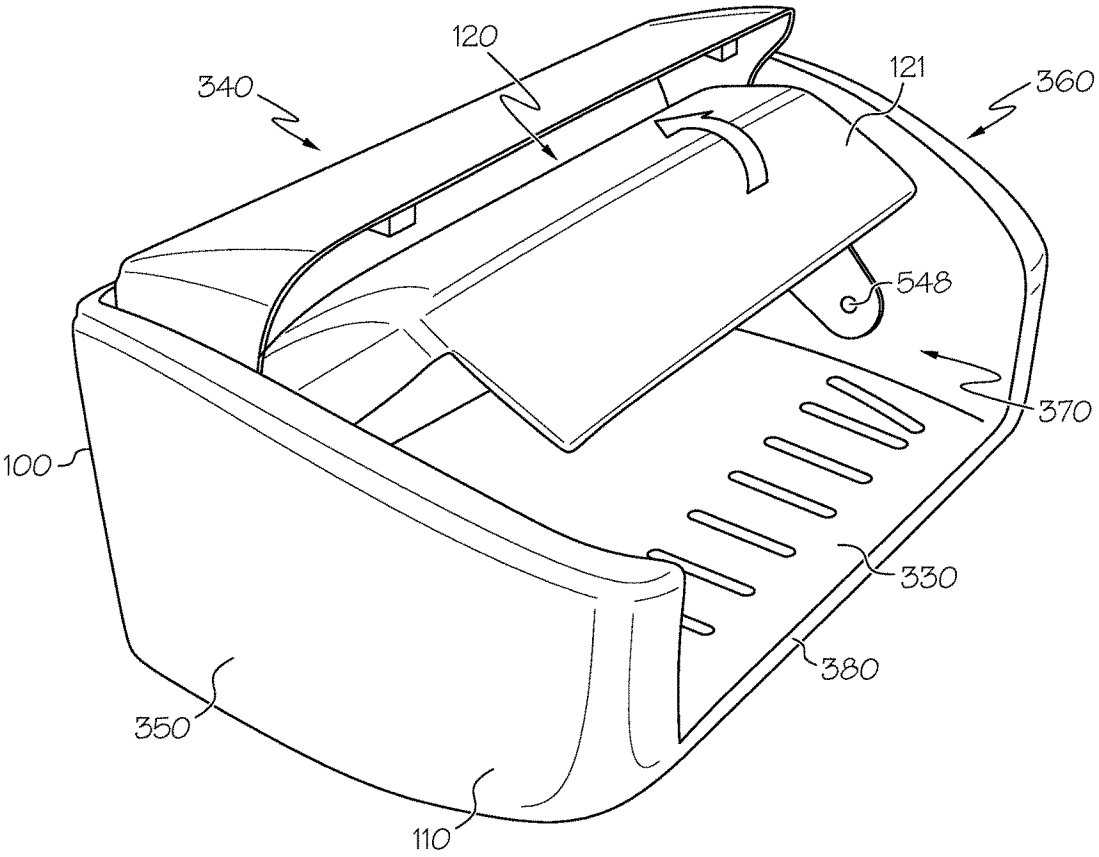
FIG. 3 is a perspective view of an example storage bin according to an embodiment illustrating the movement of the two-piece lid mechanism.

FIG. 3 illustrates additional portions of the storage bin 100 and schematically depicts the movement of the two-piece lid mechanism 120. The container portion 110 has a bottom wall 330, a rear outer wall 340, a left side wall 350 (when the storage bin 100 is viewed frontally), a right side wall 360, and an open front 370 configured to be covered by the front lid portion 121 of the two-piece lid mechanism 120. The container portion 110 has a step 380 elevated from the bottom wall 330 towards the open front 370. The step 380 inhibits any items that may be stored in the container portion 110 from falling out of the container portion 110.

Figure 4:
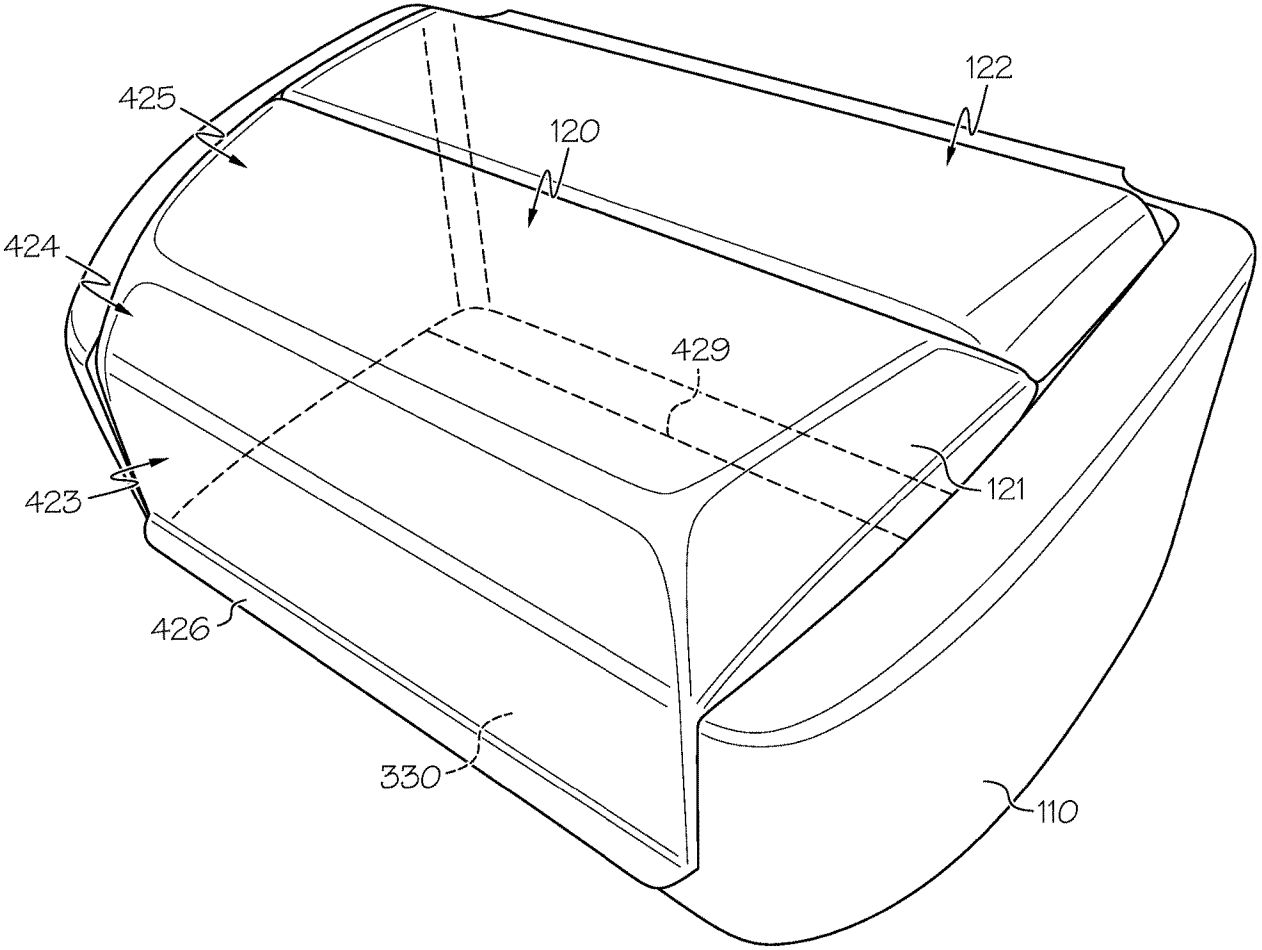
FIG. 4 is another perspective view of an example storage bin according to an embodiment illustrating portions of the two-piece lid mechanism and of the container portion.

FIG. 4 provides an enlarged view of the front lid portion 121 of the two-piece lid mechanism 120. The front lid portion 121 has a first wall 423, a second wall 424, and a third wall 425.

When the two-piece lid mechanism 120 is closed, the third wall 425 extends over items stored in the front of the container portion 110 and the first wall 423 of the front lid portion 121 extends in front of items stored in the front area of the container portion 110 to inhibit the items from falling out of the container portion 110.

When the two-piece lid mechanism 120 is open, the first wall 423 of the front lid portion 121 extends over items stored in the rear area of the container portion 110 and the third wall 425 of the front lid portion 121 extends behind items stored in the rear area of the container portion 110.

As shown in FIG. 4, the front lid portion 121 has a lip portion 426. The lip portion 426 allows easy and convenient access for the user when the user opens the front lid portion 121.

The lip portion 426 is shaped to extend outwardly from the first wall 423. Preferably, the lip portion 426 extends outwardly from the first wall 423 at an angle of approximately 90°. However, different angles and other configurations of the shape of the lip portion 426 may be utilized.

As shown in FIG. 4, the first wall 423 is substantially vertical when the two-piece lid mechanism 120 is closed. Substantially vertical in this instance means that the first wall 423 extends downwardly from the top surface of the front lid portion 121 to the bottom wall 330 of the container portion 110 such that the front of the bin is closed and there is space under the lid for storing items.

Turning back to FIG. 2, the first wall 423 is substantially horizontal when the two-piece lid mechanism 120 is open. Substantially horizontal in this instance means that the first wall 423 extends along the top surface of the front lid portion 121 from the front of the bin towards the rear wall of the container portion 110.

Turning again to FIG. 4, the third wall 425 is substantially horizontal when the two-piece lid mechanism 120 is closed. Substantially horizontal in this instance means that the third wall 425 extends along the top surface of the front lid portion 121 from the front of the bin towards the rear wall of the container portion 110.

Turning back to FIG. 2, the third wall 425 is substantially vertical when the two-piece lid mechanism 120 is open. Substantially vertical in this instance means that the third wall 425 extends downwardly from the top surface of the front lid portion 121 to the bottom wall 330 of the container portion 110 such that the front of the bin is open.

As shown in FIG. 4, when the two-piece lid mechanism 120 is open, the third wall 425 of the front lid portion 121 is separated from the usable portion of the container portion 110 by a ridge 429 configured to extend across the rear area of the container portion 110.

Figure 5:
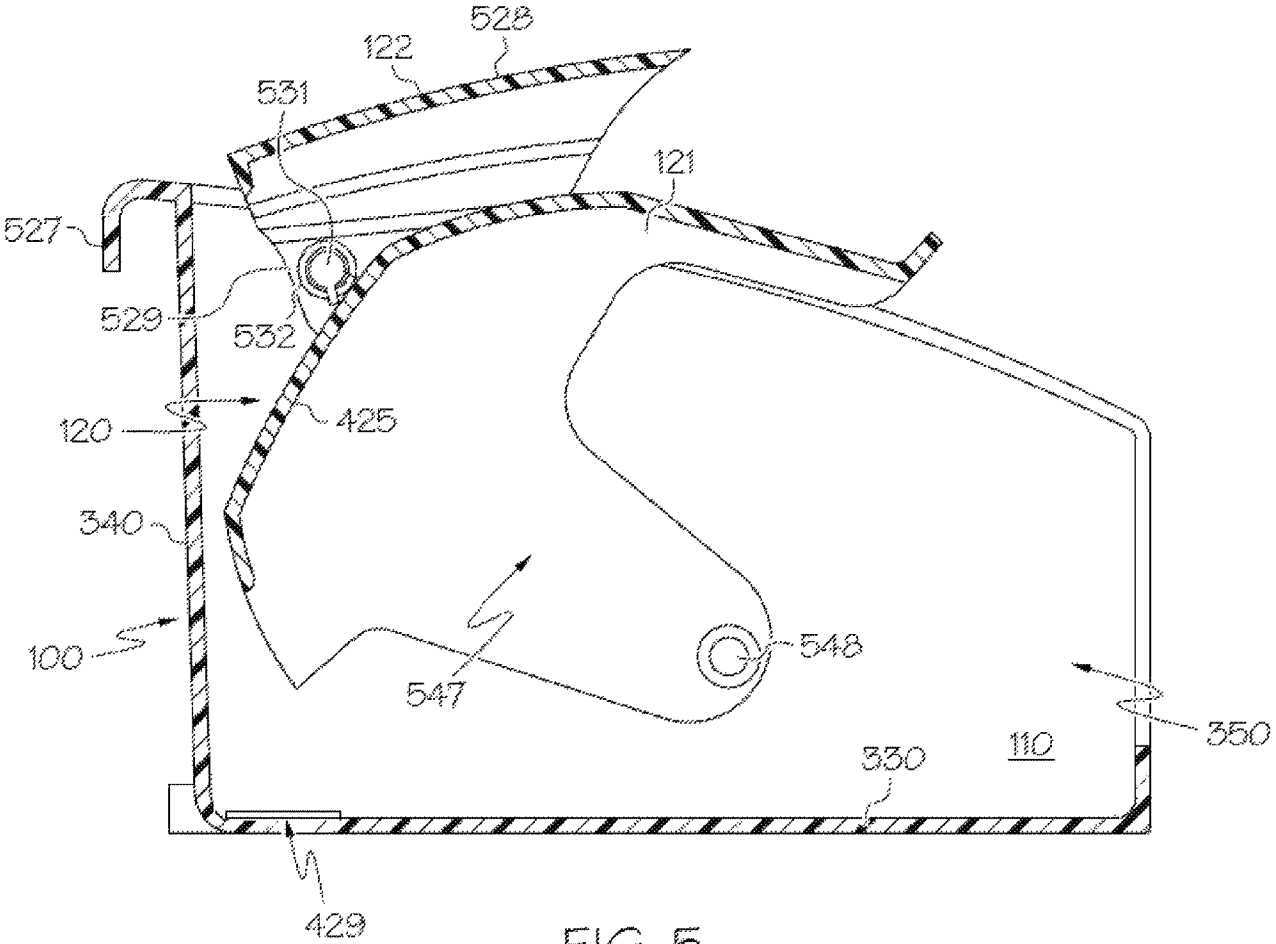
FIG. 5 is a schematic view of an example storage bin according to an embodiment illustrating elements of the two-piece lid mechanism.

FIG. 5 provides a schematic view of the front lid portion 121 and the rear lid portion 122 of the storage bin 100.

As shown in FIG. 5, the front lid portion 121 has arms 547 on both sides of the front lid portion 121 (only one arm 547 is shown in FIG. 5). When the front lid portion 121 is closed, the arms 547 are configured to extend vertically from the third wall 425 and along the left side wall 350 and the right side wall 360 (only one side wall is shown in FIG. 5) of the container portion 110 towards the bottom wall 330 of the container portion 110 over fastening points 548. The fastening points 548 are mounted on predetermined locations at the inside portions of the left side wall 350 and the right side wall 360 of the container portion 110. The predetermined locations of the fastening points 548 will be described in more detail with reference to FIG. 6 below. The arms 547 are pivotably fastened to the fastening points 548 in such a way that the front lid portion 121 can be pivoted from a closed position to an open position and from an open position to a closed position.

As further shown in FIG. 5, the rear lid portion 122 has a main wall 528 and two shoulders 529 on both sides (only one shoulder 529 is shown on FIG. 5). When the rear lid portion 122 is closed, the two shoulders 529 extend vertically from the main wall 528 and along the left side wall 350 and the right side wall 360 (only one side wall is shown in FIG. 5) of the container portion 110 towards the bottom wall 330 of the container portion 110.

As illustrated in FIG. 5, each back portion of the two shoulders 529 has a post 531 with a stopper 532 which surrounds the post 531.

The rear lid portion 122 is pivotably attached by the post 531 to the upper rear portions of the left side wall 350 and the right side wall 360 of the container portion 110 (only one side wall is depicted in FIG. 5) at the back portions of the two shoulders 529.

Each stopper 532 keeps the rear lid portion 122 from falling into the container portion 110. Each stopper 532 also limits the rear lid portion 122 from being moved into a position other than the position that would allow the rear lid portion 122 to interact with the front lid portion 121.

As shown in FIG. 5, the storage bin 100 may be configured to be mounted within one or more recesses in an inner wall of a refrigerator door.

For example, the storage bin 100 may have a mounting portion 527 on the rear outer wall 340 of the storage bin 100. Alternatively, the mounting portion 527 may be configured to removably attach the storage bin 100 within the one or more recesses in the inner wall of a refrigerator door.

Figure 6:
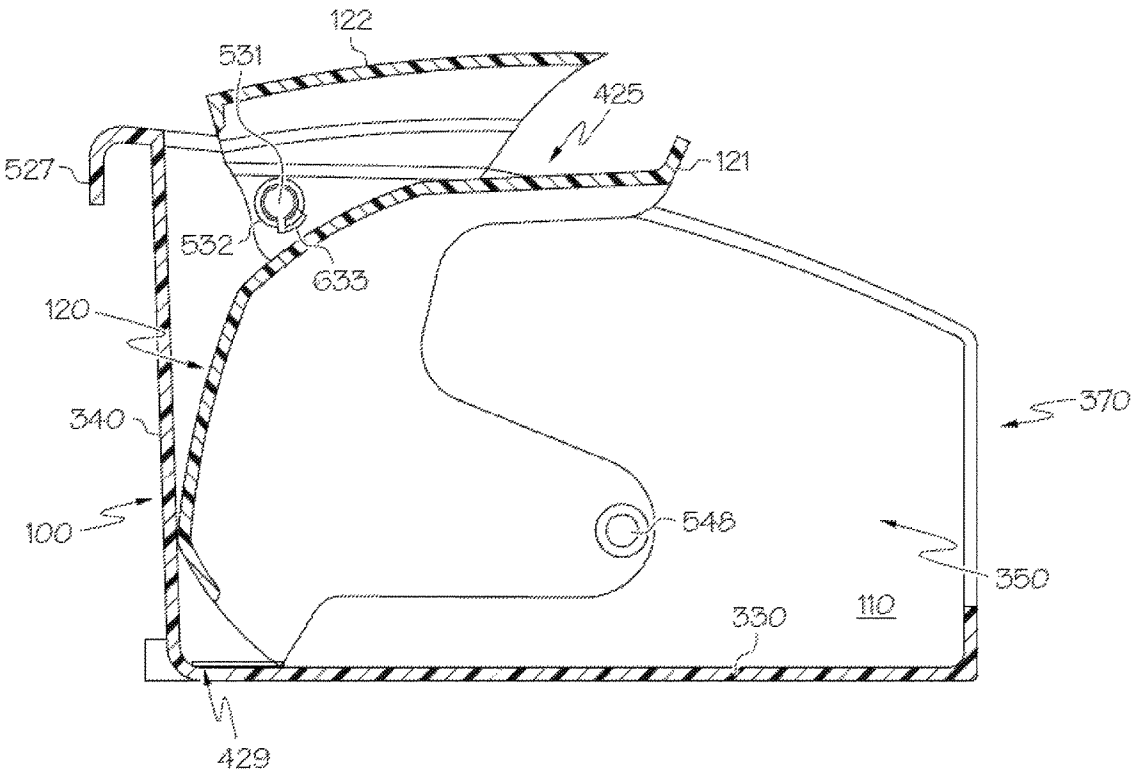
FIG. 6 is a schematic cross-sectional side view of an example storage bin according to an embodiment illustrating the locations of the pivots relative to the dimensions of the storage bin walls.

FIG. 6 illustrates the locations of the fastening points 548 which connect the front lid portion 121 to the container portion 110 of the storage bin 100. Preferably, the distance from the fastening points 548 to the third wall 425, which forms the top of the front lid portion 121 in fully closed position, is less than the distance from the fastening points 548 to the rear wall 340 to provide clearance for the front lid portion 121 to pivot around the fastening points 548. The above-described location of the fastening points 548 allows the front lid portion 121 in its fully open position to extend as close as possible to the rear outer wall 340 of the container portion 110 of the storage bin 100. This configuration provides maximum usable place in the container portion 110 of the storage bin 100 and avoids interferences with the pivoting of the front lid portion 121.

As further shown in FIG. 6, each post 531 mounted on the back portion of the two shoulders 529 of the rear lid portion 122 is inserted into a key-shaped recess 633 in the upper rear portion of the left side wall 350 and the right side wall 360 of the container portion 110 (only one side wall is depicted in FIG. 5). Each post 531 extends through the key-shaped recess 633.

The movement of the rear lid portion 122 is defined by each stopper 532, which in conjunction with the key-shaped recess 633, limits the adjustment of the rear lid portion 122.

Figure 7:
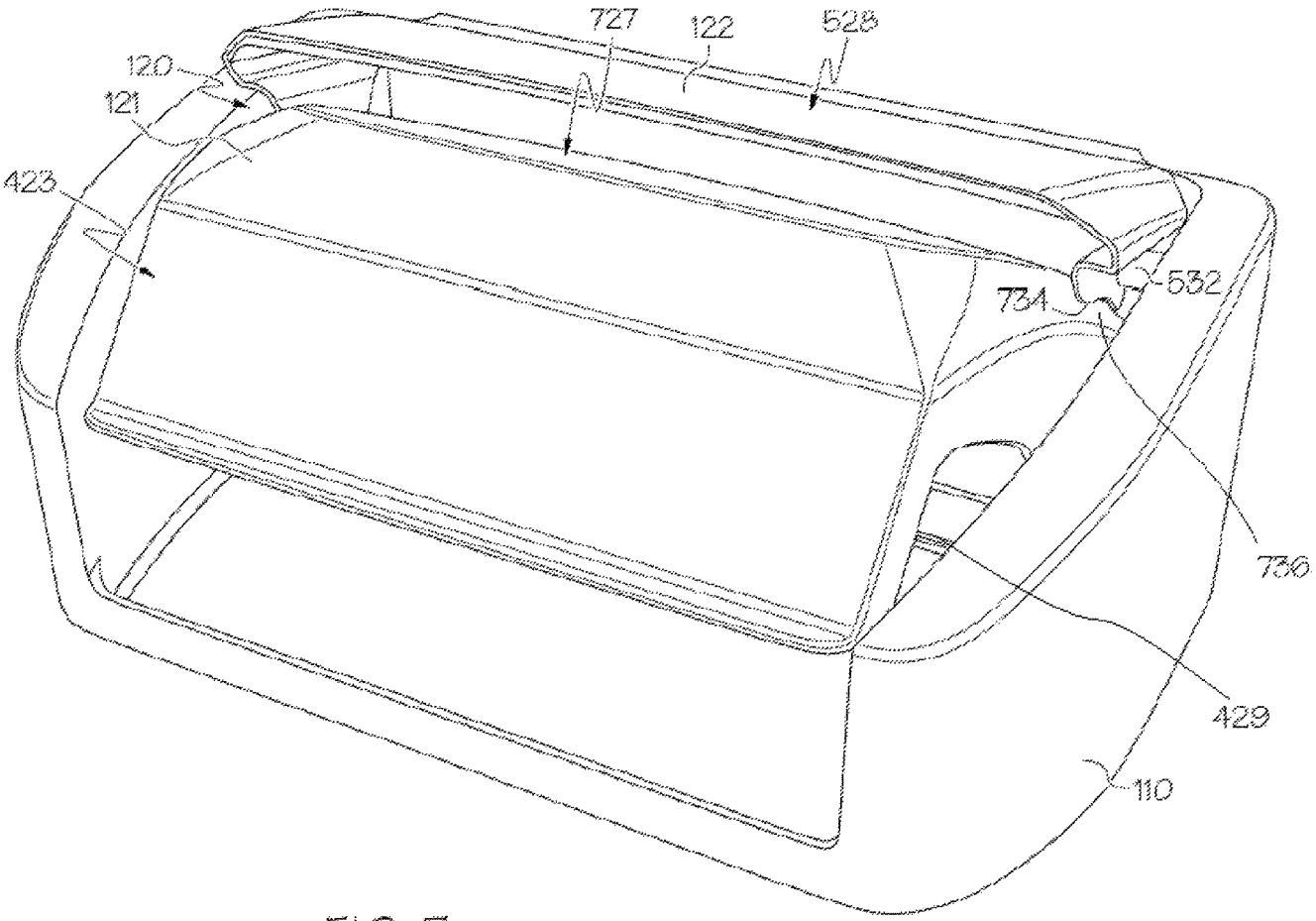
FIG. 7 is a perspective view of an example storage bin according to an embodiment illustrating portions of the two-piece lid mechanism.

FIG. 7 provides a perspective view of the rear lid portion 122 and the front lid portion 121 of the storage bin 100. As shown in FIG. 7, the front part of the main wall 528 of the rear lid portion 122 has sloped runners 734. The shape of the sloped runners 734 is configured to allow the front lid portion 121 to lift the rear lid portion 122 by engagement with the front lid portion 121 when the front lid portion 121 is opened. Movement of the rear lid portion 122 occurs when the sloped runners 734 slide over the top surface 727 of the front lid portion 121 during opening and closing of the two-piece lid mechanism 120.

The rear lid portion 122 can be in the same position regardless whether the two-piece lid mechanism 120 is open or closed.

As the front lid portion 121 is opened and the first wall 423 of the front lid portion 121 is raised, the sloped runners 734 slide along cam surfaces 736 over the top surface 727 of the front lid portion 121 that corresponds with the sloped runners 734.

Each of the cam surfaces 736 has a shape configured to generate a desired motion to allow the front lid portion 121 to fit under the rear lid portion 122 when the two-piece lid mechanism 120 is fully open.

Turning back to FIG. 3, the front lid portion 121 of the two-piece lid mechanism 120 rotates around its horizontal axis on the post 548 (as shown in FIG. 5). As the front lid portion 121 opens, initially, the rear lid portion 122 is raised slightly above the top plane surface 223 (shown in FIG. 2) of the two-piece lid mechanism 120. Once the top surface 727 (shown later in FIG. 7) of the front lid portion 121 engages the sloped runners 734 (also shown later in FIG. 7) of the rear lid portion 122, the sloped runners 734 slide along the top surface 727 like a cam follower riding on a cam. When the front lid portion 121 is fully opened, most of the front lid portion 121 fits underneath the rear lid portion 122 as shown in FIGS. 2 and 6.

Figure 8:
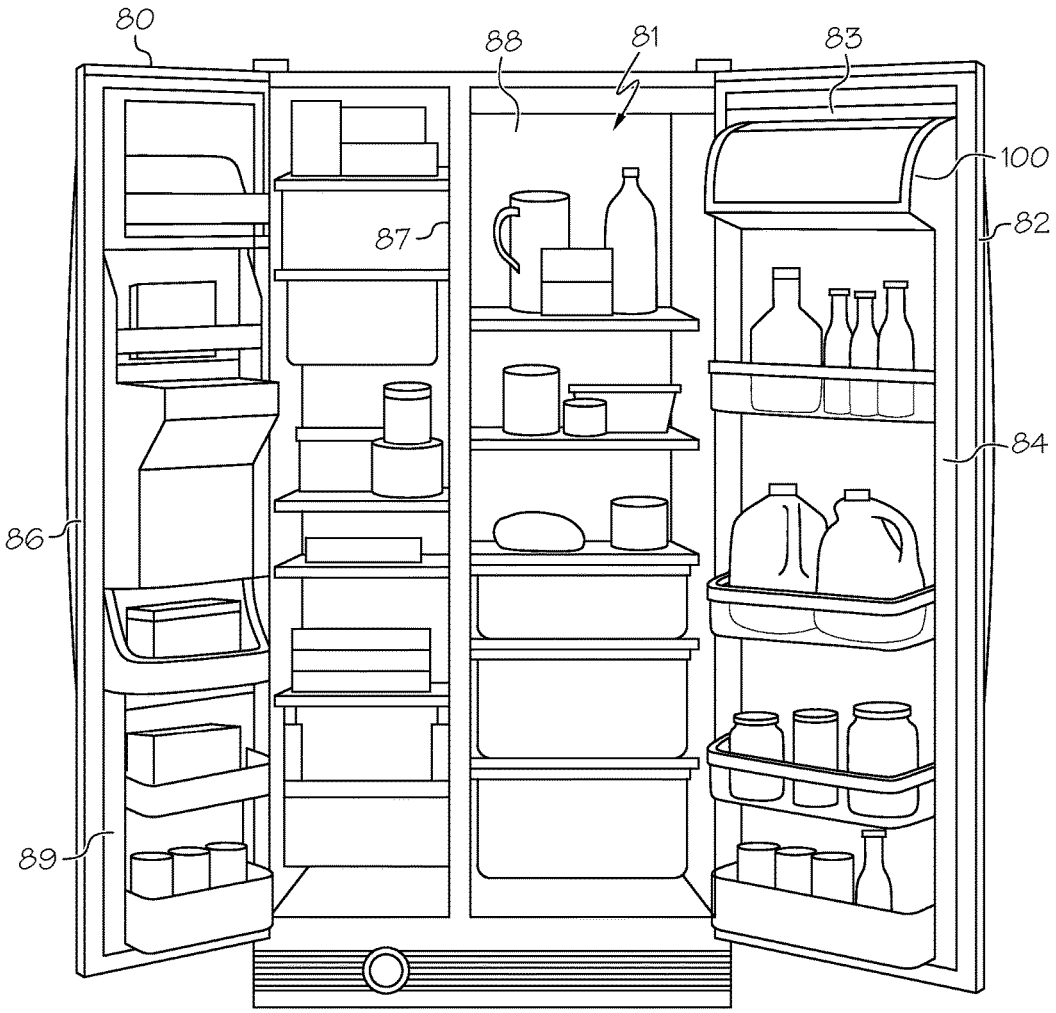
FIG. 8 is a schematic view of an example refrigerator, including a schematic depiction of an example storage bin with a two-piece lid mechanism mounted to a refrigerator door in accordance with aspects of the present disclosure.

FIG. 8 shows a refrigerator 80, according to an embodiment. The refrigerator 80 has at least one cabinet 81 for storing items, at least one door 82, and at least one storage bin 100 mounted within at least one recess 83 in the inner wall 84 of the refrigerator door 82. The storage bin 100 has a container portion 110 for storing items and a two-piece lid mechanism 120. The two-piece lid mechanism 120 has a front lid portion 121 configured to cover the front area of the container portion 110 and a rear lid portion 122 configured to cover the rear area of the container portion 110. The front lid portion 121 provides access to the items stored in the container portion 110 when the front lid portion 121 is open. When the front lid portion 121 is opened, the rear lid portion 122 is configured to slide along the top surface 727 of the front lid portion 121 and the front lid portion 121 is configured to rotatably fit underneath the rear lid portion 122.

In one embodiment, the storage bin 100 may be mounted within a recess 83 that is located at the top of the inner wall 84 of the refrigerator door 82. However, embodiments are not limited thereto. For example, the storage bin 100 may be mounted within a recess 83 located at a lower portion of the inner wall 84 of the refrigerator door 82 or at the bottom of the inner wall 84 of the refrigerator door 82.

In the embodiment where the storage bin 100 is mounted within a recess 83 that is located at the top of the inner wall 84 of the refrigerator door 82, when the front lid portion 121 is fully opened, neither the front lid portion 121 nor the rear lid portion 122 extend above the top plane surface 223 of the two-piece lid mechanism 120 when the two-piece lid mechanism 120 is in a closed position. Therefore, the fully-opened two-piece lid mechanism 120 will not extend above the refrigerator door 82 and will not interfere with the refrigerator cabinet 81 when attempts to close the refrigerator door 82 are made by the user.

Figure 9:
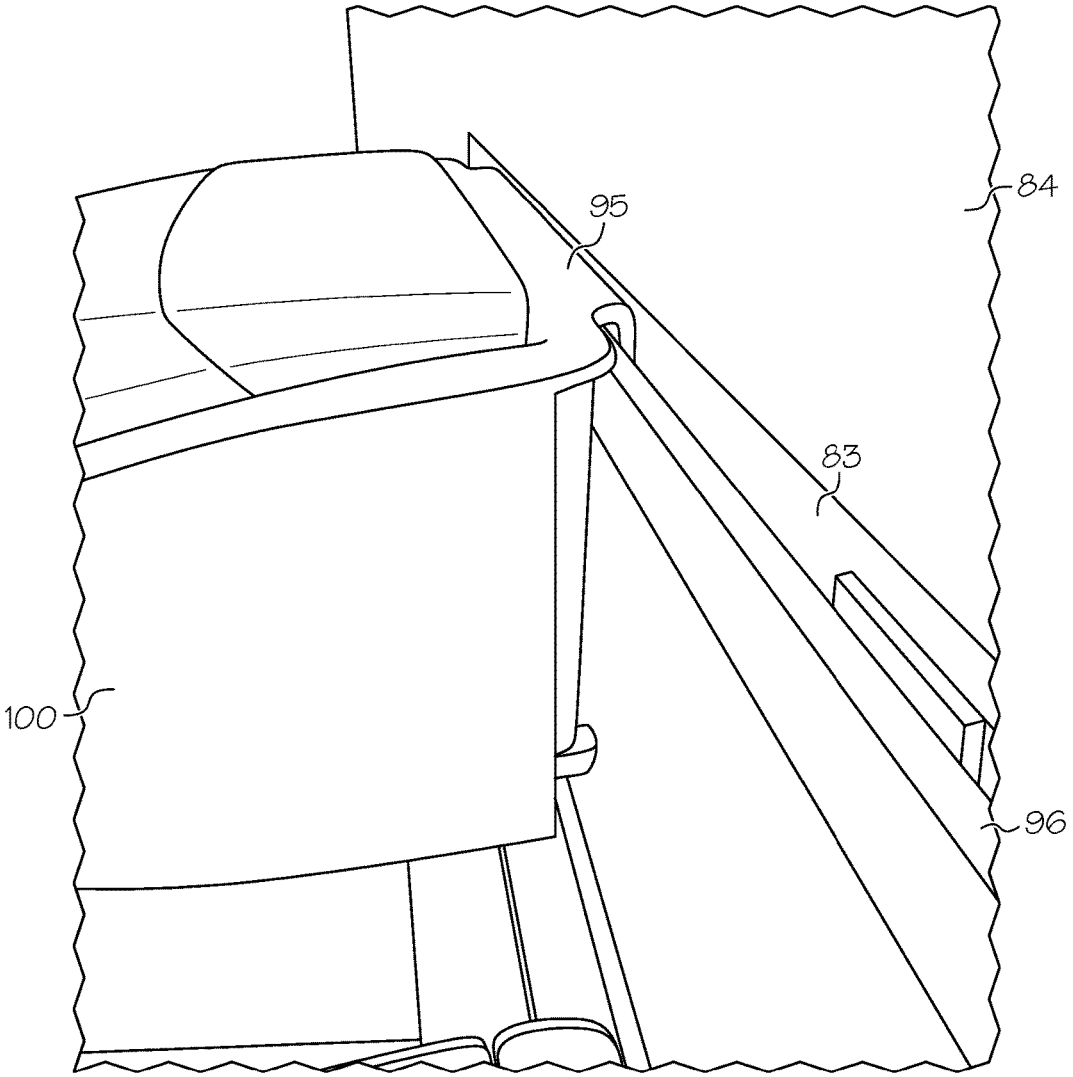
FIG. 9 is an enlarged perspective view of an example storage bin according to an embodiment illustrating an example mounting structure.

The mounting of the storage bin 100 within the recess 83 may be achieved using any type of mounting member having a shape that would correspond to a shape of the recess 83. For example, as is illustrated in FIG. 9, a one-piece curved fastener 95 may be configured to enter the recess 83 and hang on at least one of the horizontal rails 96 at the opening of the recess 83 to removably mount the storage bin 100 to the inner wall 84 of the refrigerator door 82. However, embodiments are not limited thereto. For example, more than one curved fastener 95 may be utilized depending on the size of the storage bin 100. In addition, any type of removable curved fastener, such as, but not limited to, anchors, grapples, hangers, or hooks, may be used to mount the storage bin 100 to the inner wall 84. Further, the shapes of the curved fastener 95 and the horizontal rails 96 may be configured to allow the storage bin 100 to slide along the width of the horizontal rails 96. The storage bin 100 may also have flanges on the opposing ends of the rear outer wall 340 of the container portion 110. Each flange may have a female mounting recess adapted to mate with a protruding male appendage within a recess 83 in the inner wall 84 of the refrigerator door 82. The storage bin 100 may also be permanently molded within the recess 83.

Turning back to FIG. 8, while FIG. 8 illustrates a refrigerator 80 having a recess 83 extending horizontally across a width of the inner wall 84, embodiments disclosed herein are not limited thereto. For example, the inner wall 84 may include rows of recesses 83 therein. The rows of the recesses 83 may stretch across the width of the inner wall 84. Some of the recesses 83 themselves may not extend across the width of the inner wall 84. A row of recesses 83 may occupy the inner wall 84 at a particular height that differs from all other rows of recesses 83. An opening of each of the recesses 83 may be defined by the inner wall 84. The recesses 83 may extend into and behind portions of the inner wall 84 defining openings of the recesses 83. The recesses 83 may be designed to accommodate a variety of mounting configurations of different storage bins that would correspond with the recesses 83.

While it is illustrated in FIG. 8 that the recesses 83 are disposed solely on the inner wall 84 of the fresh food door 82, embodiments disclosed herein are not limited thereto. For example, the recesses 83 may additionally be included within the inner wall 89 of the freezer door 86. Further, the recesses 83 may be included within the side walls 87 and the rear wall 88 of the insulated cabinet 81.

The terms "approximately" and "substantially," if used herein, are terms of estimation.

Many other example embodiments can be provided through various combinations of the above described features. Although the embodiments described hereinabove use specific examples and alternatives, it will be understood by those skilled in the art that various additional alternatives may be used and equivalents may be substituted for elements and/or steps described herein, without necessarily deviating from the intended scope of the application. Modifications may be necessary to adapt the embodiments to a particular situation or to particular needs without departing from the intended scope of the application. It is intended that the application not be limited to the particular example implementations and example embodiments described herein, but that the claims be given their broadest reasonable interpretation to cover all novel and non-obvious embodiments, literal or equivalent, disclosed or not, covered thereby.

What is claimed is:

1. A storage bin comprising:

a container portion; and a two-piece lid mechanism, said two-piece lid mechanism comprising:

a front lid portion configured to cover a front area of the container portion when the two-piece lid mechanism is in a closed position, said front lid portion comprising a first wall, a second wall, and a third wall defining a top surface; and a rear lid portion configured to cover a rear area of the container portion when the two-piece lid mechanism is in the closed position, wherein:

when the front lid portion is moved to an open position, the rear lid portion slides along the top surface of the front lid portion and the front lid portion fits rotatably underneath the rear lid portion;

wherein the container portion comprises a ridge formed on a bottom wall of the container portion, said ridge separating a rear area of the bottom wall from a front area of the bottom wall and extending across a width of the rear area of the bottom wall; wherein when the two-piece lid mechanism is moved to the open position, the third wall of the front lid portion moves to the rear area of the container portion, extending behind the ridge and above the rear area of the bottom wall, and is configured to be separated from items stored in the front area of the bottom wall by the ridge and the rear lid portion is pivotably attached to the container portion.

2. The storage bin according to claim 1, wherein the container portion comprises a rear outer wall, a left side wall, a right side wall, an open front configured to be covered by the front lid portion of the two-piece lid mechanism, and a step elevated from the bottom wall towards the open front, said step configured to inhibit items stored in the front area of the container portion from falling out of the container portion.

3. The storage bin according to claim 2, wherein the rear lid portion comprises a main wall and two shoulders configured to extend from the main wall towards the bottom wall of the container portion and wherein the two shoulders comprise sloped runners configured to lift the rear lid portion by engagement with the front lid portion when the front lid portion is moved to the open position.

4. The storage bin according to claim 3, wherein the rear lid portion is pivotably attached to an upper rear portion of the left side wall and the right side wall at each back portion of the two shoulders, wherein each back portion of the two shoulders comprises a post with a stopper configured to surround the post, and wherein each post is inserted into a key-shaped recess in the upper rear portion of the left side wall and the right side wall of the container portion and wherein each post extends through the key-shaped recess in the upper rear portion of the left side wall and the right side wall.

5. The storage bin according to claim 4, wherein a movement of the rear lid portion is defined by each stopper, wherein each stopper, in conjunction with the key-shaped recess, limits an adjustment of the rear lid portion, and wherein each stopper keeps the rear lid portion from falling into the container portion and wherein each stopper limits the rear lid portion from being moved to a position other than a position allowing the rear lid portion to interact with the front lid portion.

6. The storage bin according to claim 3, wherein when the front lid portion is open while the first wall of the front lid portion is raised, the sloped runners slide along cam surfaces over the top surface of the front lid portion that corresponds with the sloped runners.

7. The storage bin according to claim 6, wherein each of the cam surfaces has a shape configured to generate a desired motion to allow the front lid portion to fit under the rear lid portion when the two-piece lid mechanism is fully open.

8. The storage bin according to claim 3, wherein a movement of the rear lid portion occurs when the sloped runners slide over the top surface of the front lid portion during opening and closing of the two-piece lid mechanism.

9. The storage bin according to claim 2, wherein the front lid portion comprises arms on both sides of the front lid portion, wherein when the two-piece mechanism is in the closed position, said arms are configured to extend vertically from the third wall and along the left side wall and the right side wall of the container portion towards the bottom wall of the container portion over fastening points mounted on predetermined locations at inside portions of the left side wall and the right side wall of the container portion and said arms being pivotably fastened to the fastening points configured to allow the front lid portion to be pivoted from the closed position to the open position, and from the open position to the closed position.

10. The storage bin according to claim 9, wherein a distance from the fastening points to the third wall is less than the distance from the fastening points to the rear outer wall.

11. The storage bin according to claim 3, further comprising a mounting portion on the rear outer wall.

12. The storage bin according to claim 11, wherein the mounting portion is configured to removably attach the storage bin within one or more recesses in an inner wall of a refrigerator door.

13. The storage bin according to claim 1, wherein when the two-piece lid mechanism is in the closed position, the third wall is configured to extend over items stored in the front area of the container portion, and wherein the first wall of the front lid portion is configured to extend in front of the items stored in the front area of the container portion to limit the items from falling out of the container portion.

14. The storage bin according to claim 13, wherein when the two-piece lid mechanism is open, the first wall of the front lid portion extends over items stored in the rear area of the container portion.

15. The storage bin according to claim 13, wherein the front lid portion further comprises a lip portion configured to extend outwardly from the first wall.

16. The storage bin according to claim 13, wherein the first wall is substantially vertical when the two-piece lid mechanism is in the closed position and substantially horizontal when the two-piece lid mechanism is in the open position.

17. The storage bin according to claim 13, wherein the third wall is substantially horizontal when the two-piece lid mechanism is in the closed position and substantially vertical when the two-piece lid mechanism is in the open position.

18. The storage bin according to claim 1, wherein when the front lid portion is completely opened, the front lid portion and the rear lid portion do not extend above a top plane surface of the two-piece lid mechanism when the two-piece lid mechanism is in a closed position.

19. The storage bin according to claim 1, wherein the storage bin is configured to be mounted within one or more recesses in an inner wall of a refrigerator door.

20. The storage bin according to claim 1, wherein the front lid portion and the rear lid portion overlap to cover items stored in the container portion.

21. A refrigerator comprising:

at least one cabinet;

at least one door; and at least one storage bin mounted within a recess in an inner wall of the at least one door, said at least one storage bin comprising:

a container portion; and a two-piece lid mechanism, said two-piece lid mechanism comprising:

a front lid portion configured to cover a front area of the container portion when the two-piece lid mechanism is in a closed position, said front lid portion comprising a first wall, a second wall, and a third wall defining a top surface; and a rear lid portion configured to cover a rear area of the container portion when the two-piece lid mechanism is in the closed position, wherein:

when the front lid portion is moved to an open position, the rear lid portion slides along the top surface of the front lid portion and the front lid portion fits rotatably underneath the rear lid portion;

wherein the container portion comprises a ridge formed on a bottom wall of the container portion, said ridge separating a rear area of the bottom wall from a front area of the bottom wall and extending across a width of the rear area of the bottom wall; wherein when the two-piece lid mechanism is moved to the open position, the third wall of the front lid portion moves to the rear area of the container portion, extending behind the ridge and above the rear area of the bottom wall, and is configured to be separated from items stored in the front area of the bottom wall by the ridge and the rear lid portion is pivotably attached to the container portion.

22. The refrigerator according to claim 21, wherein when the two-piece mechanism is fully open, the two-piece lid mechanism will not extend above the door and interfere with the cabinet.

23. A refrigerator door comprising:

at least one inner wall;

at least one recess formed in said at least one inner wall; and at least one storage bin mounted within the at least one recess, said at least one storage bin comprising:

a container portion; and a two-piece lid mechanism comprising:

a front lid portion configured to cover a front area of the container portion when the two-piece lid mechanism is in a closed position, said front lid portion comprising a first wall, a second wall, and a third wall defining a top surface; and a rear lid portion configured to cover a rear area of the container portion when the two-piece lid mechanism is in the closed position, wherein:

when the two-piece lid mechanism is in the closed position, the third wall extends over items stored in the front area of the container portion, when the front lid portion is moved to an open position, the rear lid portion slides along the top surface of the front lid portion and the front lid portion fits rotatably underneath the rear lid portion;

wherein the container portion comprises a ridge formed on a bottom wall of the container portion, said ridge separating a rear area of the bottom wall from a front area of the bottom wall and extending across a width of the rear area of the bottom wall, and wherein when the two-piece lid mechanism is moved to the open position, the third wall of the front lid portion moves to the rear area of the container portion, extending behind the ridge and above the rear area of the bottom wall, and is configured to be separated from items stored in the front area of the bottom wall by the ridge.

* * * * *